US008651977B2

(12) United States Patent
Isogawa et al.

(10) Patent No.: US 8,651,977 B2
(45) Date of Patent: Feb. 18, 2014

(54) GOLF BALL

(75) Inventors: Kazuhiko Isogawa, Kobe (JP); Tsutomu Hirau, Kobe (JP)

(73) Assignee: SRI Sports Limited, Kobe (JP)

( * ) Notice: Subject to any disclaimer, the term of this patent is extended or adjusted under 35 U.S.C. 154(b) by 8 days.

(21) Appl. No.: 12/222,103

(22) Filed: Aug. 1, 2008

(65) Prior Publication Data

US 2009/0054176 A1 Feb. 26, 2009

(30) Foreign Application Priority Data

Aug. 22, 2007 (JP) ..... 2007-216214

(51) Int. Cl.
*A63B 37/12* (2006.01)

(52) U.S. Cl.
USPC ..... 473/378

(58) Field of Classification Search
USPC ..... 473/378, 351
See application file for complete search history.

(56) References Cited

U.S. PATENT DOCUMENTS

| | | | | |
|---|---|---|---|---|
| 6,022,279 | A * | 2/2000 | Yamagishi et al. | 473/378 |
| 6,435,984 | B1 * | 8/2002 | Ohama | 473/377 |
| 6,561,923 | B1 | 5/2003 | Ohama et al. | |
| 7,568,986 | B2 * | 8/2009 | Watanabe et al. | 473/378 |

FOREIGN PATENT DOCUMENTS

| | | | |
|---|---|---|---|
| JP | 6-170013 | A | 6/1994 |
| JP | 2000-254250 | A | 9/2000 |
| JP | 2004-81350 | A | 3/2004 |
| JP | 2007-144097 | A | 6/2007 |

OTHER PUBLICATIONS

Japanese Office Action issued on May 15, 2012 and partial English Translation for Japanese Patent Application No. 2007-216214.

* cited by examiner

*Primary Examiner* — Raenn Gorden
(74) *Attorney, Agent, or Firm* — Birch, Stewart, Kolasch & Birch, LLP

(57) ABSTRACT

Golf ball 2 has spherical main body 4, mark layer 6 and paint layer 8. The main body 4 has spherical core 10, and cover 12 provided to cover this core 10. The cover 12 does not include titanium oxide. The cover 12 includes a fluorescent colorant. The main body 4 has a chroma saturation of equal to or greater than 25. The paint layer 8 is constituted with a resin composition. This resin composition includes composite particles. The composite particle has a nucleus, and a coat layer provided to coat this nucleus. The nucleus is constituted with mica, while the coat layer is constituted with titanium oxide. The amount of the composite particles is 2 parts by weight or greater and 30 parts by weight or less per 100 parts by weight of the base resin of the paint layer 8.

7 Claims, 3 Drawing Sheets

GOLF BALL

This application claims priority on Patent Application No. 2007-216214 filed in JAPAN on Aug. 22, 2007. The entire contents of this Japanese Patent Application are hereby incorporated by reference.

BACKGROUND OF THE INVENTION

1. Field of the Invention

The present invention relates to golf balls.

2. Description of the Related Art

Golf balls have a core and a cover. General golf balls are white colored. The coloring has been achieved by dispersing titanium dioxide in the cover. Titanium dioxide has strong masking ability. The color of the core is masked by titanium dioxide. The coloring may be also achieved by dispersing a white pigment in a paint layer.

Golf players may misidentify their own ball from other player's ball because most golf balls are white. A penalty is imposed on the golf player who hit the ball of any other player.

The golf ball may be also colored blue, red or the like. These golf balls are referred to as "color ball". In the color balls, a large amount of a pigment is dispersed in the cover or the paint layer. The color balls can be easily distinguished from the white balls. However, the color balls are inferior in high-grade looking. Many golf players avoid selection of the color balls.

Golf balls have marks printed thereon. The mark includes brand name and ball number. Golf players can distinguish their ball from other's ball by the brand. The golf players can distinguish their ball from other's ball also by the ball number. The golf players get close to the ball, and distinguish it based on such marks. It is difficult to distinguish the ball based on the mark from a distance.

Japanese Unexamined Patent Application Publication No. Hei 6-170013 discloses a golf ball having a paint layer that includes composite particles. The composite particles include mica, and titanium oxide coating this mica. This golf ball has luminance. An appearance of this golf ball exhibits a polarization property. The luminance and the polarization property may achieve high-grade looking of the golf ball.

Japanese Unexamined Patent Application Publication No. 2000-24139 (U.S. Pat. No. 6,561,923) discloses a golf ball having a cover that includes a fluorescent colorant together with titanium dioxide. Distinguishability from the white golf balls is achieved by the fluorescent colorant.

According to the golf ball disclosed in Japanese Unexamined Patent Application Publication No. Hei 6-170013, the luminance and the polarization property are achieved by mica as described above. However, when this golf ball is viewed by a golf player from far away, it is difficult to be distinguished from common white balls. In addition, this golf ball is less likely to be found by a golf player from far away. This golf ball is inferior in the distinguishability and visibility.

Improvement of the chroma saturation by a fluorescent colorant is intended according to the golf ball disclosed in Japanese Unexamined Patent Application Publication No. 2000-24139. However, titanium dioxide inhibits the chroma saturation. The golf ball having a low chroma saturation is inferior in the visibility and the distinguishability. High chroma saturation is attained when titanium dioxide is not blended in the cover, or when it is blended in a small amount. However, a cover that includes a small amount of titanium dioxide is inferior in the masking ability. Thus, the color of the core may be revealed on the surface of the ball. Furthermore, when a small amount of titanium dioxide is included, a contour of the dimple becomes unclear. The golf ball having a cover that includes a small amount of titanium dioxide is inferior in the high-grade looking, and may make the golf player feel sense of incongruity.

An object of the present invention is to provide a golf ball that does not make the golf players feel sense of incongruity, and is excellent in visibility and distinguishability, with high-grade looking.

SUMMARY OF THE INVENTION

The golf ball according to the present invention has a spherical main body, and a paint layer provided so as to cover this main body. This main body has a core, and a cover provided so as to cover this core. This cover does not include titanium oxide but includes a fluorescent colorant. The main body has a chroma saturation of equal to or greater than 25. The paint layer includes a polarizing material.

Preferably, the polarizing material is a composite particle having a nucleus, and a coat layer provided so as to coat this nucleus. The nucleus is constituted with mica or a metal oxide. The coat layer includes titanium oxide.

When the paint layer is constituted with a resin composition, the amount of the polarizing material is 2 parts by weight or greater and 30 parts by weight or less per 100 parts by weight of a base resin of the resin composition.

In the golf ball according to the present invention, high chroma saturation is attained since the cover does not include titanium oxide but includes a fluorescent colorant. Polarization property is achieved by the polarizing material in the paint layer. This golf ball is excellent in visibility and distinguishability. According to this golf ball, the polarizing material exerts masking ability. Therefore, the color of the core is not revealed, and a clear contour of the dimple is obtained. This golf ball exhibits high-grade looking, and does not make golf players feel sense of incongruity.

DESCRIPTION OF THE PREFERRED EMBODIMENTS

Hereinafter, the present invention will be described in detail according to the preferred embodiments with appropriate references to the accompanying drawing.

Figure 1:
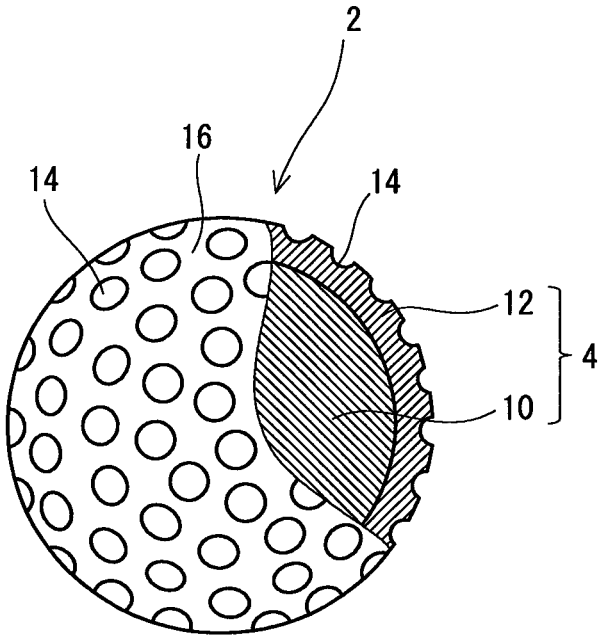
FIG. 1 shows a cross-sectional view illustrating a part of a golf ball according to one embodiment of the present invention.
Figure 2:
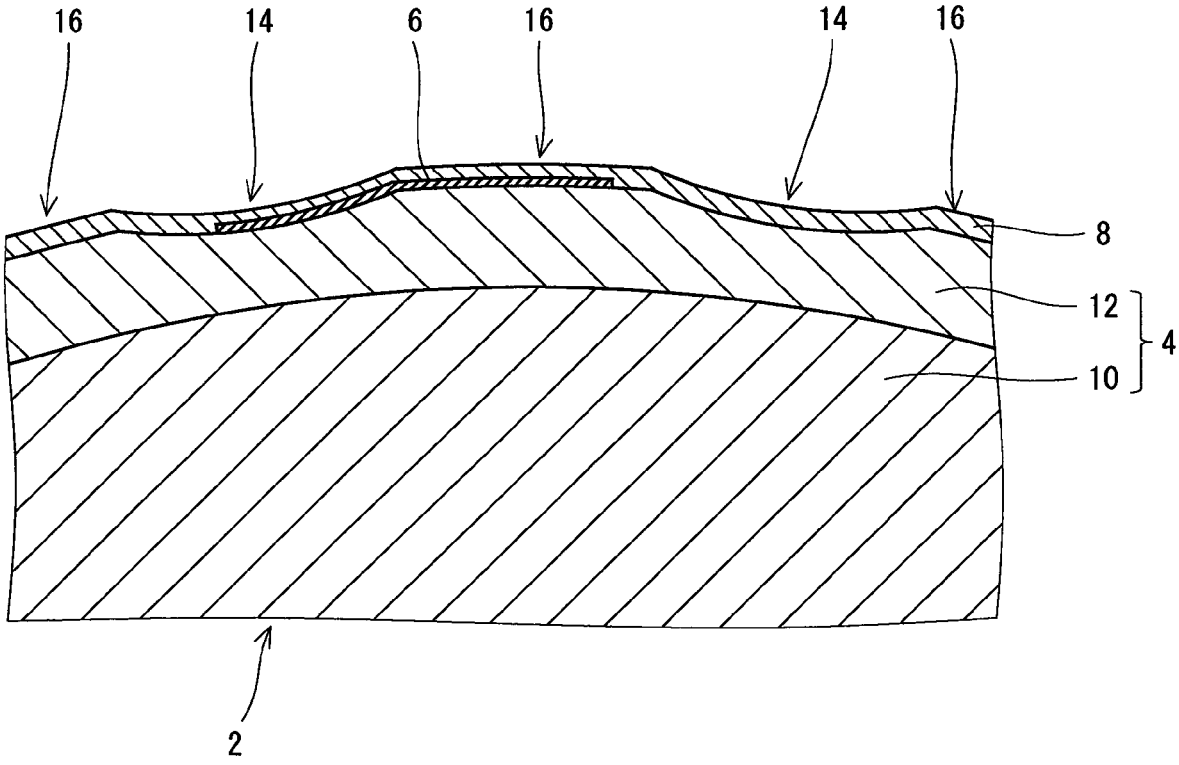
FIG. 2 shows an enlarged cross-sectional view illustrating a part of the golf ball shown in FIG. 1.

Golf ball 2 shown in FIG. 1 has a spherical main body 4, a mark layer 6 and a paint layer 8. The mark layer 6 is formed on the surface of this main body 4. The paint layer 8 covers the main body 4 and the mark layer 6. The main body 4 has a spherical core 10, and a cover 12 provides so as to cover this core 10. This golf ball 2 has dimples 14 and land 16 on the surface thereof. The mark layer 6 and the paint layer 8 are not shown in FIG. 1. The golf ball 2 may also have other paint layer between the cover 12 and the mark layer 6.

The core 10 is formed by crosslinking a rubber composition. Illustrative examples of a base rubber for use in the rubber composition include polybutadienes, polyisoprenes, styrene-butadiene copolymers, ethylene-propylene-diene copolymers and natural rubbers. For the crosslinking, a co-crosslinking agent is preferably used. Preferably, the rubber composition includes an organic peroxide. The core 10 may be composed of two or more layers.

The cover 12 is constituted with a resin composition. A thermoplastic resin or a thermosetting resin can be used for the cover 12. Typical resin may be an ionomer resin and polyurethane. The cover 12 may include a styrene elastomer, a polyamide elastomer, a polyester elastomer and a polyolefin elastomer.

The cover 12 includes a fluorescent colorant. When an ultraviolet ray is irradiated on this fluorescent colorant, a visible light is emitted. This visible light can attain a high chroma saturation of the main body 4. A pink fluorescent colorant, a yellow fluorescent colorant, an orange fluorescent colorant, a blue fluorescent colorant or the like can be used. Illustrative examples of the fluorescent colorant specifically include trade names "DG-R428 (pink)", "ZQ-11 (pink)", "ZQ-13 (red orange)", "ZQ-14 (orange)", "ZQ-15 (orange)", "ZQ-17 (yellow)" and "ZQ-19 (blue)" available from DAYGLO COLOR CORP. Two or more of the fluorescent colorants may be used in combination.

The main body 4 has a chroma saturation S of equal to or greater than 25. The golf ball 2 having this main body 4 is excellent in visibility and distinguishability. In this respect, the chroma saturation S is more preferably equal to or greater than 30, still more preferably equal to or greater than 35, and particularly preferably equal to or greater than 38. In light of the visibility and the distinguishability, lightness L* of the main body 4 is preferably equal to or greater than 60, anymore preferably equal to or greater than 73.

In the present invention, the color of the main body 4 and the golf ball 2 is represented by indices L*, a*, and b* in the CIELAB space. The indices L*, a* and b* are calculated according to the following formulae:

$$L^*=116(Y/Yn)^{1/3}-16;$$

$$a^*=500((X/Xn)^{1/3}-(Y/Yn)^{1/3}); \text{ and}$$

$$b^*=200((Y/Yn)^{1/3}-(Z/Zn)^{1/3})$$

In these formulae, X, Y and Z represent tristimulus values XYZ, while Xn, Yn and Zn represent tristimulus values XYZ of a perfect reflecting diffuser. The CIELAB space conforms to a standard determined by Commission Internationale de l'Echairage (CIE) in 1976. In Japan, the CIELAB space is employed in "JIS Z 8729".

L* is an index of lightness. The a* and b* are indices that correlate with hue and chroma saturation. The increasing negative values of a* indicate green direction, while the increasing positive values thereof indicate red direction. The increasing negative values of b* indicate blue direction, while the increasing positive values thereof indicate yellow direction. The chroma saturation S is calculated by the following formula:

$$S=((a^*)^2+(b^*)^2)^{1/2}$$

In the present invention, the indices L*, a*, and b* of the main body 4 or the golf ball 2 are determined with a color difference meter "CM-3500d" available from Minolta Co., Ltd. A light receiver is applied on the surface of the main body 4 or the golf ball 2, whereby a measurement is carried out. A "standard illuminant $D_{65}$" is employed as a light source. A correlated color temperature of this light source is 6504 k. The spectral sensitivity employed may be "2° standard observer".

The amount of the fluorescent colorant may be determined ad libitum such that the chroma saturation of equal to or greater than 25 is attained depending on its type. When DG-R428 described above is blended, the amount is preferably 0.01 parts by weight or greater and 0.10 parts by weight or less per 100 parts by weight of a base resin of the cover 12.

The cover 12 does not include titanium oxide. Deterioration of the chroma saturation resulting from titanium oxide is not caused in this cover 12. This cover 12 exhibits the effect of the fluorescent colorant enough.

Into the cover 12 may be blended an antioxidant, an ultraviolet absorbent, a light stabilizer, a fluorescent brightening agent and the like in an appropriate amount as needed. A colorant other than the fluorescent colorant may be blended in a small amount in the cover 12. The cover 12 has a thickness of 0.1 mm or greater and 3.5 mm or less.

The mark layer 6 is constituted with an ink composition. This ink composition includes a base resin and a pigment. Illustrative examples of the base resin specifically include epoxy resins, polyester polyol, polyether polyol, polyurethane polyol and nitrocellulose. The mark layer 6 has a color that is different from the color of the cover 12. The mark layer 6 displays manufacturer's name, brand name, ball number and the like.

The mark layer 6 is formed by subjecting the surface of the cover 12 to printing. Pad printing, engraving printing, ink jet printing, transfer film printing or the like can be employed. In light of productivity, pad printing is preferred.

The paint layer 8 covers the cover 12 or the mark layer 6. The mark layer 6 is protected by the paint layer 8. The paint layer 8 is formed by applying a paint. Electrostatic coating, spray gun coating, brush coating or the like can be employed. Illustrative examples of the base resin for the paint include polyurethane, epoxy resins, polyester, acrylic resins, cellulose resins and the like. In light of durability of the paint layer 8, two-component cured polyurethane is preferred.

The two-component cured polyurethane is obtained by a reaction of a base material and a curing agent. The two-component cured polyurethane prepared by a reaction of a base material containing a polyol component with a curing agent containing polyisocyanate (including a polyisocyanate derivative) is preferred.

It is preferred that urethane polyol be used as the polyol component of the base material. The urethane polyol has urethane bonds and at least two hydroxyl groups. Preferably, the urethane polyol has a hydroxyl groups at its end. The urethane polyol may be obtained by allowing polyol and polyisocyanate to react at a ratio by which an excess molar ratio of the hydroxyl group of the polyol component to the isocyanate groups of polyisocyanate is provided.

The polyol for use in production of the urethane polyol has multiple hydroxyl groups. Polyols having a weight average molecular weight of 50 or greater and 2,000 or less, and particularly 100 or greater and 1,000 or less are preferred. Examples of the polyol having a low molecular weight include diols and triols. Specific examples of the diol include ethylene glycol, diethylene glycol, triethylene glycol, 1,3-butanediol, 1,4-butanediol, neopentyl glycol and 1,6-hexanediol. Specific examples of the triol include glycerin, trimethylolpropane and hexanetriol. Examples of the polyol having a high molecular weight include polyether polyols such as polyoxyethylene glycol (PEG), polyoxypropylene glycol (PPG) and polyoxytetramethylene glycol (PTMG); condensed polyester polyols such as polyethylene adipate (PEA), polybutylene adipate (PBA) and polyhexamethylene adipate (PHMA); lactone based polyester polyols such as poly-ϵ-caprolactone (PCL); polycarbonate polyols such as polyhexamethylene carbonate; and acrylic polyols. Two or more kinds of the polyol may be used in combination.

The polyisocyanate for use in production of the urethane polyol has multiple isocyanate groups. Specific examples of the polyisocyanate include aromatic polyisocyanates such as 2,4-toluene diisocyanate, 2,6-toluene diisocyanate, mixtures of 2,4-toluene diisocyanate and 2,6-toluene diisocyanate (TDI), 4,4'-diphenylmethane diisocyanate (MDI), 1,5-naphthylene diisocyanate (NDI), 3,3'-bitolylene-4,4'-diisocyanate (TODI), xylylene diisocyanate (XDI), tetramethylxylylene diisocyanate (TMXDI) and paraphenylene diisocyanate (PPDI); alicyclic polyisocyanates such as 4,4'-dicyclohexylmethane diisocyanate ($H_{12}MDI$), hydrogenated xylylene diisocyanate ($H_6XDI$) and isophorone diisocyanate (IPDI); and aliphatic polyisocyanates such as hexamethylene diisocyanate (HDI). Two or more polyisocyanates may be used in combination. In light of weather resistance, TMXDI, XDI, HDI, $H_6XDI$, IPDI and $H_{12}MDI$ are preferred.

In the reaction of the polyol and polyisocyanate for producing the urethane polyol, any known catalyst can be used. Typical catalyst may be dibutyltin dilaurate.

The proportion of the urethane bonds included in the urethane polyol is preferably 0.1 mmol/g or greater and 5 mmol/g or less. The urethane polyol having this proportion of equal to or greater than 0.1 mmol/g can serve in achieving scuff resistance of the paint layer 8. The urethane polyol having this proportion of equal to or less than 5 mmol/g can serve in achieving following capability of the paint layer 8 with the cover 12. The paint layer 8 that is excellent in the following capability is less likely to be cracked in repeated hitting of the golf ball 2. The proportion of the urethane bonds may be adjusted to fall within the above range by regulating the molecular weight of the polyol to be the raw material. The proportion of the urethane bonds may be adjusted to fall within the above range also by regulating compounding ratio of the polyol and the polyisocyanate.

In light of a short time period required for the reaction of the base material with the curing agent, the urethane polyol has a weight average molecular weight of preferably equal to or greater than 4,000, and more preferably equal to or greater than 4,500. In light of the adhesiveness between the paint layer 8 and the cover 12, the weight average molecular weight is preferably equal to or less than 10,000, and more preferably equal to or less than 9,000.

In light of the adhesiveness between the paint layer 8 and the cover 12, the urethane polyol has a hydroxyl value (mg KOH/g) of preferably equal to or greater than 15, and more preferably equal to or greater than 73. In light of a short time period required for the reaction of the base material with the curing agent, and inhibition of cracking, the hydroxyl value is preferably equal to or less than 130, and more preferably equal to or less than 120.

The base material may contain, in addition to the urethane polyol, a polyol not having any urethane bond. The aforementioned polyol as the raw material of the urethane polyol may be used in the base material. Polyols that are miscible with the urethane polyol are preferred. In light of a short time period required for the reaction of the base material with the curing agent, the proportion of the urethane polyol in the base material is preferably equal to or greater than 50% by weight, and more preferably equal to or greater than 80% by weight based on the solid content. Ideally, this proportion is 100% by weight.

The curing agent contains polyisocyanate or a derivative thereof. The aforementioned polyisocyanate as the raw material of the urethane polyol may be used in the curing agent.

Figure 3:
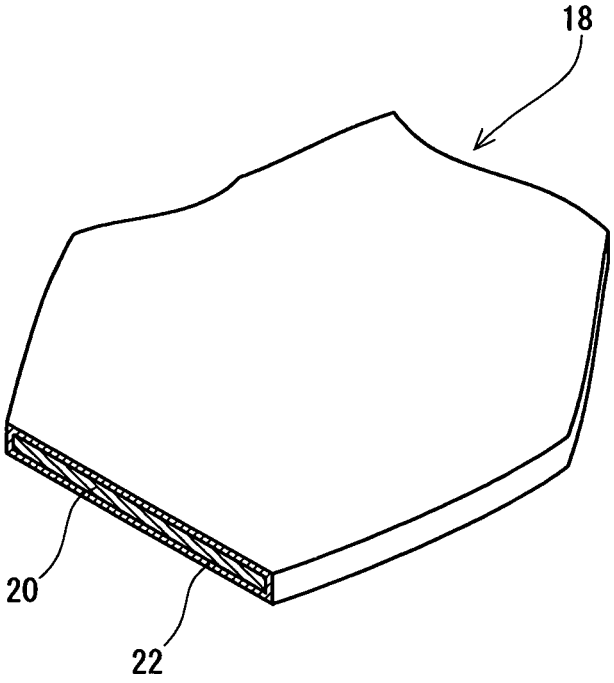
FIG. 3 shows a cross-sectional perspective view illustrating a composite particle blended in the paint layer of the golf ball shown in FIG. 1.

The paint for the paint layer 8 includes composite particles as a polarizing material. The composite particles are dispersed in the paint layer 8. FIG. 3 shows a cross-sectional perspective view illustrating the composite particle 18. This composite particle 18 includes a nucleus 20, and a coat layer 22. The nucleus 20 is constituted with mica. The coat layer 22 is constituted with titanium oxide. A part of the light ray entered into the paint layer 8 is reflected on the coat layer 22. A part of the light ray entered into the paint layer 8 passes through the coat layer 22, and is reflected on the nucleus 20. The reflected light on the coat layer 22 interferes with the reflected light on the nucleus 20. This interference imparts luminance to the golf ball 2. The appearance of the golf ball 2 having the luminance is different from the appearance of conventional golf balls. This golf ball 2 is excellent in the visibility and the distinguishability. In addition, the golf ball 2 having the luminance is excellent in high-grade looking.

As shown in FIG. 3, the composite particles 18 are flaky. The flaky composite particles 18 are accompanied by directionality in the interferential action. The composite particle 18 has varying colors depending on the angle of view. The polarization property is imparted to the golf ball 2 by dispersing the flaky composite particles 18. This polarization property achieves the visibility, the distinguishability and the high-grade looking of the golf ball 2.

These composite particles 18 have strong masking ability. As described above, the cover 12 does not include titanium oxide, but the composite particles 18 prevent the color of the core 10 from being revealed. In addition, the composite particles 18 serve in clear recognition of the contour of the dimple 14. This golf ball 2 does not make the golf player feel sense of incongruity.

The coat layer 22 constituted with titanium oxide contributes to the luminance of the golf ball 2. Typically, titanium dioxide is used in the coat layer 22. The coat layer 22 may also include a small amount of a pigment. When the coat layer 22 includes a material other than titanium oxide, the proportion of titanium oxide in the coat layer 22 may be equal to or greater than 90% by weight, and still more, equal to or greater than 95% by weight. The coat layer 22 has a thickness of preferably 0.1 μm or greater and 10 μm or less.

The nucleus 20 may be constituted with a metal oxide. This nucleus 20 is less likely to subject to color change. This nucleus 20 does not compromise weather resistance of the golf ball 2. Since the metal oxide is excellent in strength, the nucleus 20 does not compromise durability of the paint layer 8. The composite particle 18 in which the nucleus 20 is constituted with a metal oxide is less likely to subject to disruption in kneading the resin composition. Suppression of the disruption imparts a sufficient polarization property to the golf ball 2. Furthermore, since the metal oxide has strong masking ability, the sense of incongruity may be restrained.

Illustrative example of preferable metal oxide for the nucleus 20 may be aluminum oxide ($Al_2O_3$). The aluminum oxide imparts more satisfactory luminance. The aluminum oxide serves in attaining the high-grade looking of the golf ball 2. Additionally, the aluminum oxide is excellent in strength.

A polarizing material other than the composite particle 18 may be also dispersed in the paint layer 8. Illustrative examples of the polarizing material other than the composite particle 18 include aluminum flakes and glass flakes.

The polarizing material has a particle size of preferably 5 μm or greater and 50 μm or less. The polarizing material having a particle size of equal to or greater than 5 μm may achieve the luminance and the polarization property. In this respect, the particle size is more preferably equal to or greater than 10 μm. Use of the polarizing material having a particle size of equal to or less than 50 μm may achieve smoothness of the paint layer 8. In this respect, the particle size is more preferably equal to or less than 30 μm. The particle size is a number average particle diameter measured by Laser Scattering Particle Size Distribution Analyzer "LA-910", available from Horiba, Ltd.

The amount of the polarizing material in the paint layer 8 is preferably 2 parts by weight or greater and 30 parts by weight or less per 100 parts by weight of the base resin of the paint layer 8. Excellent luminance is exhibited by dispersing 2 parts by weight or more polarizing material in the paint layer 8. Additionally, on the golf ball 2 with this amount of equal to or greater than 2 parts by weight, clear recognition of the contour of the dimple 14 by the golf player is enabled. In this respect, the amount is more preferably equal to or greater than 3 parts by weight, and particularly preferably equal to or greater than 5 parts by weight. According to the paint layer 8 including 30 parts by weight or less polarizing material, excellent visibility can be achieved. Furthermore, according to the paint layer 8 including 30 parts by weight or less polarizing material, the durability of the paint layer 8 is not compromised by the polarizing material. In this respect, the amount is more preferably equal to or less than 20 parts by weight, and particularly preferably equal to or less than 15 parts by weight.

Into the paint may be blended additives such as an antioxidant, an ultraviolet absorbent, a light stabilizer, and the like in an appropriate amount as needed. The paint layer 8 has a thickness of 3 μm or greater and 100 μm or less. Other paint layer may be provided on the external side of the paint layer 8.

In light of the visibility, the golf ball 2 has a lightness L* of preferably equal to or greater than 60, more preferably equal to or greater than 65, and particularly preferably equal to or greater than 70. In light of the visibility and the distinguishability, the golf ball 2 has a chroma saturation of more preferably equal to or greater than 30, still more preferably equal to or greater than 35, and particularly preferably equal to or greater than 38.

EXAMPLES

Example 1

A rubber composition was obtained by kneading 100 parts by weight of polybutadiene (trade name "BR-730", available from JSR Corporation), 25 parts by weight of zinc diacrylate, 10 parts by weight of zinc oxide, 6 parts by weight of titanium dioxide, 15 parts by weight of barium sulfate, 0.5 parts by weight of diphenyl disulfide (Sumitomo Seika Chemicals Co., Ltd.) and 0.8 parts by weight of dicumyl peroxide (NOF Corporation). This rubber composition was placed into a mold having upper and lower mold half each having a hemispherical cavity, and heated at 170° C. for 20 minutes to obtain a core having a diameter of 38.9 mm.

45 parts by weight of an ionomer resin neutralized with sodium (trade name "Surlyn® 8945" available from Du Pont Kabushiki Kaisha), 45 parts by weight of an ionomer resin neutralized with zinc (trade name "Surlyn® 9945" available from Du Pont Kabushiki Kaisha), 10 parts by weight of a styrene block-containing thermoplastic elastomer (trade name "Rabalon® SR04", available from Mitsubishi Chemical Corporation) and 0.05 parts by weight of a fluorescent colorant ("DG-R428", supra) were kneaded in a twin screw kneading extruder to obtain a resin composition. The aforementioned core was placed into a final mold having numerous pimples on the inside face, followed by injection of the aforementioned resin composition around the core by injection molding. The injection yielded a main body provided with a cover having a thickness of 1.9 mm. Numerous dimples having a shape inverted from the shape of the pimple were formed on the cover. The results of measurement of the color of the main body are shown in Table 1 below. The surface of this main body was subjected to a polishing process.

A clear paint including a two-component cured polyurethane as a base was prepared. The base material of this paint was a mixture of polyether polyol and polyester polyol. This base material had a hydroxyl value of 82 mg KOH/g. The curing agent of this paint was hexamethylene diisocyanate. This paint had a NCO:OH equivalence ratio of 1.3:1.0. This paint included composite particles (trade name "Iriodin 201", available from Merck & Co., Inc.) having the nucleus constituted with mica, and the coat layer constituted with titanium oxide. The amount of the composite particles was 10 parts by weight per 100 parts by weight of the base resin. The composite particles were flaky, and had a particle size of 15 μm. The paint was applied on the cover with a spray gun. The paint was dried at a temperature of 40° C. for 120 min to give a paint layer having a thickness of about 10 μm. Thus, a golf ball of Example 1 having a diameter of 42.7 mm and a weight of about 45.4 g was obtained.

Examples 2 to 3 and Comparative Example 1

Golf balls of Examples 2 to 3 and Comparative Example 1 were obtained in a similar manner to Example 1 except that the amount of the fluorescent colorant in the cover was as shown in Table 1 below.

Examples 4 to 7 and Comparative Example 2

Golf balls of Examples 4 to 7 and Comparative Example 2 were obtained in a similar manner to Example 1 except that the amount of the composite particles in the paint layer was as shown in Table 2 below.

Examples 8 to 9 and Comparative Examples 3 to 6

Golf balls of Examples 8 to 9 and Comparative Examples 3 to 6 were obtained in a similar manner to Example 1 except that the resin composition of the cover was as shown in Table 3 below. In Comparative Example 5, a colorant that is not fluorescent (pink pigment, available from Dainichiseika Colour & Chemicals Mfg. Co., Ltd., trade name "PE-D 06C539") was blended.

Examples 10 to 13

Golf balls of Examples 10 to 13 were obtained in a similar manner to Example 1 except that the composition of the paint layer was as shown in Table 4 below. Details of the polarizing material are as in the following.

T60-20

Merck & Co., Inc., trade name "Xirallic® T60-20 WNT Sunbeam Gold"

nucleus: aluminum oxide, coat layer: titanium oxide, particle size: 20 μm, flaky

T60-25

Merck & Co., Inc., trade name "Xirallic® T60-25 WNT Cosmic Turquoise"

nucleus: aluminum oxide, coat layer: titanium oxide, particle size: 20 μm, flaky

MC1080RG

Nippon Sheet Glass Co., Ltd., trade name "Metashine MC1080RG"

nucleus: glass flake, coat layer: titanium oxide, particle size: 80 μm

PM2010

ECKART LLC, trade name "ALOXAL PM2010"

aluminum flake, particle size: 20 μm

Sense of Incongruity

Ten golf player who had a golf club addressed near each golf ball. The golf players evaluated whether or not they felt sense of incongruity. Based on the number of the golf player(s) who evaluated that sense of incongruity was not felt, the following grading was made:

A: nine or more;

B: seven to eight;

C: four to six; and

D: three or less.

The results are shown in Tables 1 to 4 below.

Visibility

The golf ball was placed on grass. Ten golf players who stood at a point 30 m away from the ball evaluated the visibility. Based on the number of the golf player(s) who evaluated that the ball is highly visible, the following grading was made:

A: nine or more;

B: seven to eight;

C: four to six; and

D: three or less.

The results are shown in Tables 1 to 4 below.

Distinguishability

Each golf ball was placed on grass, together with a conventional white golf ball. Ten golf players who stood at a point 5 m away from the ball evaluated whether or not the ball of the present invention could be distinguished from the conventional golf ball. Based on the number of the golf player(s) who could easily distinguish the balls, the following grading was made:

A: nine or more;

B: seven to eight;

C: four to six; and

D: three or less.

The results are shown in the Tables 1 to 4 below.

High-Grade Looking

The appearance of each golf ball was evaluated by ten golf players. Based on the number of the golf player(s) who evaluated the ball exhibits high-grade looking, the following grading was made:

A: nine or more;

B: seven to eight;

C: four to six; and

D: three or less.

The results are shown in Tables 1 to 4 below.

TABLE 1

Evaluation Results

| | | Comp. Example 1 | Example 2 | Example 1 | Example 3 |
|---|---|---|---|---|---|
| Cover | Surlyn 8945 | 45 | 45 | 45 | 45 |
| | Surlyn 9945 | 45 | 45 | 45 | 45 |
| | Rabalon SR04 | 10 | 10 | 10 | 10 |
| | titanium dioxide | — | — | — | — |
| | DG-R428 | 0.01 | 0.03 | 0.05 | 0.07 |
| Paint layer | base resin | 100 | 100 | 100 | 100 |
| | Iriodin 201 | 10 | 10 | 10 | 10 |
| Main body | color | pink | pink | pink | pink |
| | L* | 80.4 | 76.4 | 73.5 | 70.8 |
| | a* | +22.1 | +28.5 | +34.8 | +38.2 |
| | b* | −8.0 | −11.5 | −15.5 | −19.0 |
| | chroma saturation | 23.5 | 30.7 | 38.1 | 42.7 |
| Painted ball | L* | 82.1 | 78.1 | 75.3 | 73.2 |
| | a* | +20.6 | +27.0 | +32.9 | +35.6 |
| | b* | −9.8 | −13.3 | −17.7 | −21.1 |
| Absence of sense of incongruity | | A | A | A | A |
| Visibility | | C | A | A | A |
| Distinguishability | | D | A | A | A |
| High-grade looking | | A | A | A | A |

TABLE 2

Evaluation Results

| | | Comp. Example 2 | Example 4 | Example 5 | Example 6 | Example 7 |
|---|---|---|---|---|---|---|
| Cover | Surlyn 8945 | 45 | 45 | 45 | 45 | 45 |
| | Surlyn 9945 | 45 | 45 | 45 | 45 | 45 |
| | Rabalon SR04 | 10 | 10 | 10 | 10 | 10 |
| | titanium dioxide | — | — | — | — | — |
| | DG-R428 | 0.05 | 0.05 | 0.05 | 0.05 | 0.05 |
| Paint layer | base resin | 100 | 100 | 100 | 100 | 100 |
| | Iriodin 201 | — | 1 | 5 | 20 | 35 |
| Main body | color | pink | pink | pink | pink | pink |
| | L* | 73.5 | 73.5 | 73.5 | 73.5 | 73.5 |
| | a* | +34.8 | +34.8 | +34.8 | +34.8 | +34.8 |
| | b* | −15.5 | −15.5 | −15.5 | −15.5 | −15.5 |
| | chroma saturation | 38.1 | 38.1 | 38.1 | 38.1 | 38.1 |
| Painted ball | L* | 74.2 | 74.8 | 75.0 | 75.7 | 76.2 |
| | a* | +34.6 | +33.7 | +33.3 | +32.4 | +32.0 |
| | b* | −16.2 | −17.0 | 17.4 | −18.2 | −18.8 |
| Absence of sense of incongruity | | D | B | A | A | A |
| Visibility | | B | A | A | A | B |
| Distinguishability | | A | A | A | A | A |
| High-grade looking | | D | B | A | A | A |

TABLE 3

| Evaluation Results | | | | | | | |
|---|---|---|---|---|---|---|---|
| | | Comp. Example 3 | Comp. Example 4 | Example 8 | Example 9 | Comp. Example 5 | Comp. Example 6 |
| Cover | Surlyn 8945 | 45 | 45 | 45 | 45 | 45 | 45 |
| | Surlyn 9945 | 45 | 45 | 45 | 45 | 45 | 45 |
| | Rabalon SR04 | 10 | 10 | 10 | 10 | 10 | 10 |
| | titanium dioxide | 0.04 | 0.10 | — | — | — | 3.0 |
| | DG-R428 | 0.05 | 0.05 | — | — | — | — |
| | ZQ-17 | — | — | 4.0 | — | — | — |
| | ZQ-14 | — | — | — | 3.5 | — | — |
| | PE-D 06C539 | — | — | — | — | 0.10 | — |
| Paint layer | base resin | 100 | 100 | 100 | 100 | 100 | 100 |
| | Iriodin 201 | 10 | 10 | 10 | 10 | 10 | 10 |
| Main body | color | pink | pink | yellow | orange | pink | white |
| | L* | 74.8 | 76.8 | 98.1 | 75.5 | 57.3 | 90.2 |
| | a* | +34.0 | +32.3 | −37.2 | +80.6 | +38.2 | +0.5 |
| | b* | −14.8 | −14.1 | +98.5 | +78.8 | −12.2 | −11.3 |
| | chroma saturation | 37.1 | 35.2 | 105.3 | 112.7 | 40.1 | 11.3 |
| Painted ball | L* | 76.2 | 79.9 | 99.5 | 77.1 | 58.9 | 91.0 |
| | a* | +33.2 | +30.7 | −36.8 | +78.9 | +37.7 | +1.0 |
| | b* | −16.1 | −15.4 | +97.2 | +76.8 | −13.9 | −12.4 |
| Absence of sense of incongruity | | A | A | A | A | A | A |
| Visibility | | C | D | A | A | C | C |
| Distinguishability | | A | A | A | A | C | D |
| High-grade looking | | A | A | A | A | B | A |

TABLE 4

| Evaluation Results | | | | | |
|---|---|---|---|---|---|
| | | Example 10 | Example 11 | Example 12 | Example 13 |
| Cover | Surlyn 8945 | 45 | 45 | 45 | 45 |
| | Surlyn 9945 | 45 | 45 | 45 | 45 |
| | Rabalon SR04 | 10 | 10 | 10 | 10 |
| | titanium dioxide | — | — | — | — |
| | DG-R428 | 0.05 | 0.05 | 0.05 | 0.05 |
| Paint layer | base resin | 100 | 100 | 100 | 100 |
| | T60-20 | 10 | — | — | — |
| | T60-25 | — | 10 | — | — |
| | MC1080RG | — | — | 10 | — |
| | PM2010 | — | — | — | 10 |
| Main body | color | pink | pink | pink | pink |
| | L* | 73.5 | 73.5 | 73.5 | 73.5 |
| | a* | +34.8 | +34.8 | +34.8 | +34.8 |
| | b* | −15.5 | −15.5 | −15.5 | −15.5 |
| | chroma saturation | 38.1 | 38.1 | 38.1 | 38.1 |
| Painted ball | L* | 76.2 | 76.5 | 72.3 | 70.3 |
| | a* | +33.1 | +20.5 | +24.5 | +21.3 |
| | b* | −16.2 | −10.4 | −10.5 | −8.8 |
| Absence of sense of incongruity | | A | A | B | B |
| Visibility | | A | A | A | A |
| Distinguishability | | A | A | A | A |
| High-grade looking | | A | A | B | B |

As shown in Tables 1 to 4, the golf balls of Examples are excellent in all evaluation items. Therefore, advantages of the present invention are clearly suggested by these results of evaluation.

The present invention can be applied to golf balls having a variety of structures, and one example is demonstrated herein.

The foregoing description is just for illustrative examples, therefore, various modifications can be made in the scope without departing from the principles of the present invention.

What is claimed is:

1. A golf ball which comprises a spherical main body having a core and a cover provided to cover the core, and a paint layer provided to cover the main body, the cover consisting essentially of a base resin and a fluorescent colorant, the main body having a chroma saturation of equal to or greater than 25, a lightness L* equal to or greater than 60 and equal to or less than 76.4 and an index a* equal to or greater than 28.5 and equal to or less than 80.6, and the paint layer including a polarizing material.

2. The golf ball according to claim 1, wherein the polarizing material is a composite particle having a nucleus, and a coat layer provided to coat the nucleus, and the nucleus is constituted with mica or a metal oxide, and the coat layer includes titanium oxide.

3. The golf ball according to claim 1, wherein the paint layer is constituted with a resin composition and the amount of the polarizing material is 2 parts by weight or greater and 30 parts by weight or less per 100 parts by weight of a base resin of the resin composition.

4. The golf ball according to claim 1, wherein the main body has a chroma saturation of equal to or greater than 38.

5. The golf ball according to claim 2, wherein the nucleus of the composite particle is mica.

6. The golf ball according to claim 3, wherein the amount of the polarizing material is 5 parts by weight or greater and 20 parts by weight or less per 100 parts by weight of the base resin of the resin composition.

7. The golf ball according to claim 1, wherein the main body has a lightness L* of equal to or greater than 73 and equal to or less than 76.4.

* * * * *